US005236319A

United States Patent [19]

Fischer et al.

[11] Patent Number: 5,236,319

[45] Date of Patent: Aug. 17, 1993

[54] VANE PUMP

[75] Inventors: Günter Fischer, Gemunden/Main; Rainer Knöll, Burgsinn, both of Fed. Rep. of Germany

[73] Assignee: Mannesmann Rexroth GmbH, Lohr/Main, Fed. Rep. of Germany

[21] Appl. No.: 883,126

[22] Filed: May 14, 1992

[30] Foreign Application Priority Data

May 15, 1991 [DE] Fed. Rep. of Germany ..... 4115894

[51] Int. Cl.[5] ..... F04C 15/04; F03C 2/00

[52] U.S. Cl. ..... 418/26; 418/27; 418/31; 277/165

[58] Field of Search ..... 418/30, 31, 24, 25, 418/26, 27; 277/165, 138, 103

[56] References Cited

U.S. PATENT DOCUMENTS

| | | | |
|---|---|---|---|
| 2,935,365 | 5/1960 | Dega | 277/165 |
| 3,636,824 | 1/1972 | Clark | 277/165 X |
| 3,918,855 | 11/1975 | Bornholdt | 418/30 X |
| 4,780,069 | 10/1988 | Dantlgraber et al. | 418/30 X |
| 4,950,137 | 8/1990 | Fischer et al. | 418/30 X |

FOREIGN PATENT DOCUMENTS

| | | |
|---|---|---|
| 3429935 | 2/1986 | Fed. Rep. of Germany . |
| 3725353 | 2/1989 | Fed. Rep. of Germany . |

*Primary Examiner*—Richard E. Gluck
*Attorney, Agent, or Firm*—Foley & Lardner

[57] ABSTRACT

A vane pump or a vane motor is here specified, having a variable displacement volume. The vane pump has a vane rotor and an annular stator that surrounds the rotor eccentrically and that is stabilized by means of a piston arrangement for adjusting the eccentricity that determines the displacement volume. The piston arrangement includes at least one pendulum piston that is acted upon by a pressure medium, the pendulum piston being guided in a sealed manner in a housing bore by a piston head that delimits a control space. To simplify the assembly and to decrease manufacturing costs while simultaneously improving the sealing action and increasing the peripheral life of the guide surfaces, plastic rings, which are composed of wear resistant, sliding material, or are prestressed radially, to guide the piston in the piston bore and to seal the control space are embedded, inserted or emplaced in the piston head.

8 Claims, 2 Drawing Sheets

VANE PUMP

The invention generally relates to a vane pump or a vane motor having an adjustable displacement volume.

Such hydropumps or hydromotors include the advantage that simple selection can change the displacement volume and permit the adjustment of the operating pressure. The vane pump stator is composed of a circular, concentric ring, and normally a spring is provided for moving the stator into its starting position eccentric to the rotor. The stator ring is often placed between two pistons that have a predetermined surface ratio and are acted upon by pressure from the system, whereby the maximum desired operating pressure can be adjusted with a pressure valve. Upon reaching a nominal value, the pressure valve allows the control space of the piston with the larger diameter to discharge to the tank, so that the pump only advances the quantity which the user requires.

Care must be taken with such vane pumps or vane motors, such that the stator is sufficiently stabilized during every phase of operation. This, on the one hand, is accomplished by the fact that system pressure adjusted in the high pressure range, acting on the inner running surface of the stator, is used for this stabilization. In this high pressure range, a supporting arrangement is provided in the pump housing, for example, in the form of an adjustable support bolt, having an axis which intersects the pump rotor axis vertically, and a perpendicular plane surface on which the stator rolls in order to regulate the displacement volume. This rolling movement causes a relative sliding movement in the area of the contacting surface section between at least one actuator piston that is acted upon by the pressure medium and the outer surface of the stator during the axially guided insertion of the piston into a rigid sleeve, whereby lateral forces must be absorbed during the actuation movement of piston. In order to hereby avoid increased friction resulting between the actuator piston and the sleeve and in order to counter excessive wear in the area of the sleeve it has already been suggested that the actuator piston(s) be designed as a pendulum piston(s), the piston head of which simultaneously accomplishes a sealing function and a guiding function. To provide the sealing function, two hardened steel rings that are axially distanced from each other are used on the piston head. In order to keep wear at a minimum, the piston head has a spherical shape and is subjected to heat treatment.

Unquestionably, this type of construction results in tolerance requirements that are difficult to maintain in the area of the piston bore in order to keep leakage to a minimum. In this regard, it must be considered that the pressure in the control space behind the piston head can even be as high as approximately the 300 bar range. Moreover, to decrease wear, the surface of the housing bore should be subjected to surface treatment, whereby the cost in terms of manufacturing technology increases even further.

The invention therefore has the basic task of further developing a vane pump or a vane motor, such that improved functioning also leads to simplification in manufacture and greater reliability related to production.

According to the invention, only plastic elements are used to provide the guiding and sealing functions, whereby the guide elements are composed of form-stable, wear resistant plastic that can slide. The plastic element is designed as a plastic ring and is embedded, inserted or emplaced in the piston head in such a way that it only projects from the piston surface by a radially narrow functional section. The sealing function can either be assumed by that same plastic ring, which in turn rests on a prestressed elastic ring, or is assumed by a separate plastic ring in the piston, which is either designed such that it is radially elastic in and of itself or is placed on or supported by a radially elastic annular body.

It has been shown that the construction of the pendulum piston according to the invention can be carried out with only one guiding and sealing ring in order to prevent the occurrence of extrusion action at the clearance, even at high pressure of up to the range of approximately 300 bar. The piston head can thereby feature axial dimensions that are reduced, so that the construction space required for the control of the vane pump can be decreased. Heat treatment in the area of the piston head and/or in the area of the piston bore can be eliminated, and there is increased reliability of manufacture, since greater tolerances are possible with the materials that are used. It has been further shown that, as a result of the design according to the invention, a high degree of sealing can be achieved, whereby at the same time less wear appears in the area of the contact surface between the piston and the sleeve. Finally, simplified assembly of the guide and sealing plastic ring leads to lower manufacturing costs.

A particularly advantageous embodiment results if, in addition to a separate guide ring, a radial, elastic plastic sealing ring arrangement is used which is supported on the guide ring in an axial direction on the side opposite the control space. As a result of this design, extrusion at the clearance is effectively prevented by the combination linear and pendulum movement of the piston, even if the elasticity of the seal ring is kept high.

The sealing ring arrangement can be designed as two parts, and also as one part, whereby in the latter case the radial elasticity can be directly influenced by appropriate design.

Assembling the plastic ring can be simplified even more in that the guide ring composed of form-stable plastic that is more or less free of deformation can be pushed onto the piston head.

By supporting the sealing ring directly with the guide ring there is, moreover, the additional advantage of a very space saving arrangement of the plastic rings.

The area of the piston which is required for the incorporation of the plastic element to guide the piston and to seal the control space is further reduced.

In the following, a number of exemplified embodiments of the invention are explained in more detail on the basis of the schematic drawings. Shown are:

Figure 1:
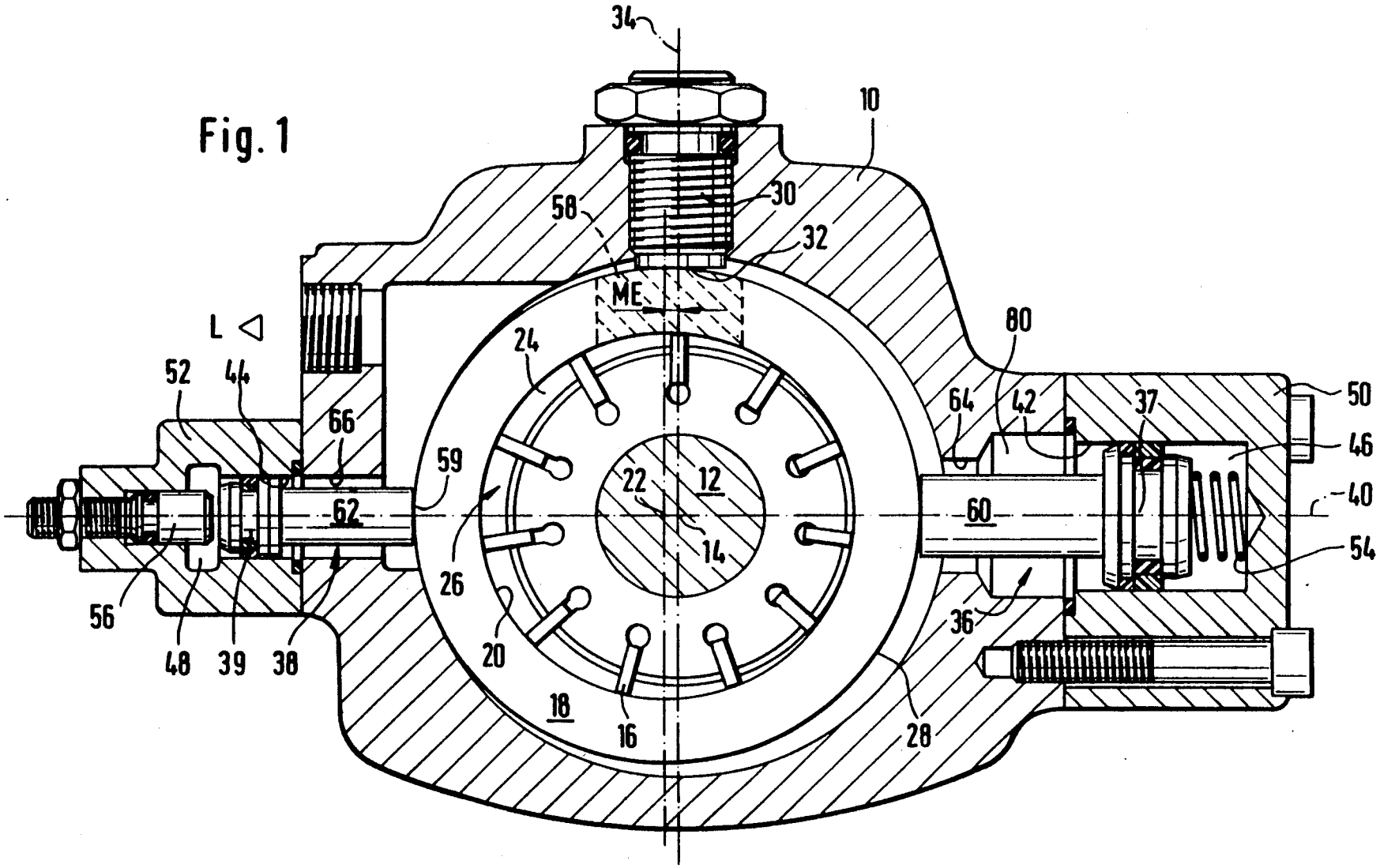
FIG. 1 is a section through a hydropump in the form of a vane pump with an adjustable displacement volume and pressure regulation.

The housing of a hydropump or a hydromotor constructed in a vane-type design is designated by 10 in FIG. 1. A rotor 12 is mounted in housing 10, the axis of rotor 12 being designated by 14. In rotor 12, vanes 16 are incorporated in radially arranged slits in a movable, guided manner, whereby vanes 16 are forced outward by the rotation of rotor 12 as a result of the centrifugal force and the system pressure behind vanes 16.

Vanes 16 lightly contact the inner surface 20 of an annular shaped stator 18, the axis of which is designated by 22. Axis 22 is displaced to an eccentric extent ME relative to axis 14 of rotor 12, so that two respectively neighboring vanes 16, which are preferably subdivided, rotor 12, stator 18 and laterally arranged control disks 24 (one of which is seen in FIG. 1) form cells or flow-medium transport chambers 26, the volumes of which decrease from the entering side toward the existing side as rotor 12 turns. The pressure that develops as a result of work resistance at the consuming device at the pressure side acts on inner surface 20 of stator 18, so that stator 18 is subjected to a pressure force directed in the upward direction. The outer surface 28 of stator 18 is supported on a face surface plane 32 of a support bolt 30, the axis 34 of which perpendicularly intersects axis 14 of the rotor 12.

To change the displacement volume of the hydropump, eccentricity dimension ME is designed so as to be adjustable. For this purpose, the ring or stator 18 is acted on at two diametrically opposed sides by coaxially arranged pistons, that is, by an actuator piston 36 and a return piston 38. Both pistons 36, 38 have a common axis 40, which expediently rests on a surface which is perpendicular to a plane that lies between axes 14 and 34.

The pistons 36, 38 respectively include a supporting part and a piston head 37, 39 which is accommodated in a piston bore 42, 44 respectively, in a sealed manner, fitting so as to slide and limiting a control space 46, 48 located to the rear. The piston bores 42, 44 or control spaces 46, 48 are preferably constructed in separate, respective mounted components 50, 52. Stator 18 is prestressed in the eccentric position when the pump starts by means of a spring 54. The maximum displacement volume can be adjusted by means of an adjustable stop 56.

Control spaces 46, 48 are regularly acted on by the system pressure, whereby a surface ratio of approximately 2:1 is selected for piston 36, 38. The maximum desired operating pressure is adjusted with a pressure valve spring (not shown) and by means of which the control space 46 associated with actuator piston 36 can discharge to the tank upon reaching a limited pressure, so that the volume that is advanced by the pump is correspondingly reversed upon reaching the set pressure. The pump thereby advances only that quantity which is required by the consuming device.

During the adjustment procedure for stator 18 that changes the displacement volume, stator 18 rolls off of face surface plane 32 of support bolt 30 in the area of a support section 58. The pressure forces transferred from the piston 36, 38 to the outer surface of stator 18 lead to the concomitant motion of piston 36, 38 at contact point 59, so that the pistons 36, 38 carry out a displacement movement and a pendulum movement. In order to allow the pendulum movement to occur, pendulum pistons 36, 38 extend with sections 60, 62 through a bore 64, 66 having a larger diameter in housing 10.

Figure 2:
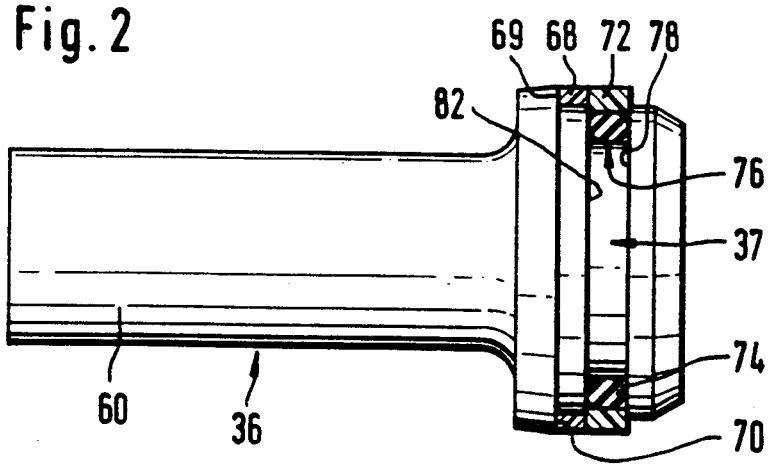
FIG. 2 is an enlarged representation of a lateral view of the pendulum actuator piston used in the form of embodiment according to FIG. 1.

This type of insertion of stator 18 results in very little friction in respective piston bores 42, 44. On the other hand, care must be taken that the sealing function of piston head 37, 39 is reliably achieved with regard to rear control space 46, 48 even at system pressures up to the range of 300 bar. Wear must also be kept low in the area of the contact surfaces between the piston 36, 38 and the bore 42, 44, even during extended, continuous duty. In order to provide for these requirements using the simplest assembly techniques and ease of manufacturing using the most economical means of production, a guide ring 68 composed of plastic is inserted or embedded in the piston head 37, 39 in order to guide the piston 36, 38. As shown in detail in FIG. 2 with respect to actuator piston 36, guide ring 68 consists of form-stable, wear resistant plastic that can slide. Expediently, this plastic is selected from an injectable thermoplastic group of plastics. Guide ring 68 is constructed in a relatively flat manner in the radial direction and has a rectangular cross section. Guide ring 68, with lateral surface 69, is supported by as much surface as possible on radial shoulder 70 on a step of the piston 36, 38.

For its part, guide ring 68 serves as an axial support for a seal ring 72 and is also composed of plastic, the material of which can be selected such that, on the one hand, a good fit is established on the opposite surface in the area of the piston bore 42, 44, and on the other hand a sufficiently greater radial elasticity can be achieved in order to transfer the sealing force. Sealing ring 72 rests on a radially elastic support ring 74 which, for example, consists of an O-ring. Seal ring 72 and support ring 74 form a seal ring arrangement which fits in a recess 76 of piston head 37. The right shoulder 78 of recess 76, according to FIG. 2, forms a means to ensure that the plastic rings 68, 72 that serve the sealing and guiding function are retained.

It has been shown that this arrangement is able to counter the occurrence of clearance extrusion with a combined linear and pendulum movement of piston 36. That is, it resists the penetration of control oil from control space 46 into housing area 80, in that seal ring 72 has a large support surface 72 on guide ring 68.

From this discussion, it can be seen that the assembly of the seal and guide elements is simplified in comparison to the state of the art. Guide ring 68 can slide on in an axial direction with little force. O-ring 74 slides on next, also without difficulty due to the great elasticity of this component. Finally, seal ring 72 is emplaced, whereby a slight radial expansion is required in order for it to slide onto piston head 37. The molding of the plastic elements and also the opposite surface near piston head 37 can take place with greater tolerances, without having to take into account losses relating to guiding and sealing functions. Also, no additional surface treatment measures are required for the piston bores 42, 44, whereby in this case the tolerances must also no longer be as close. Overall, production costs for the hydropump or the hydromotor are considerably reduced.

Figure 3:
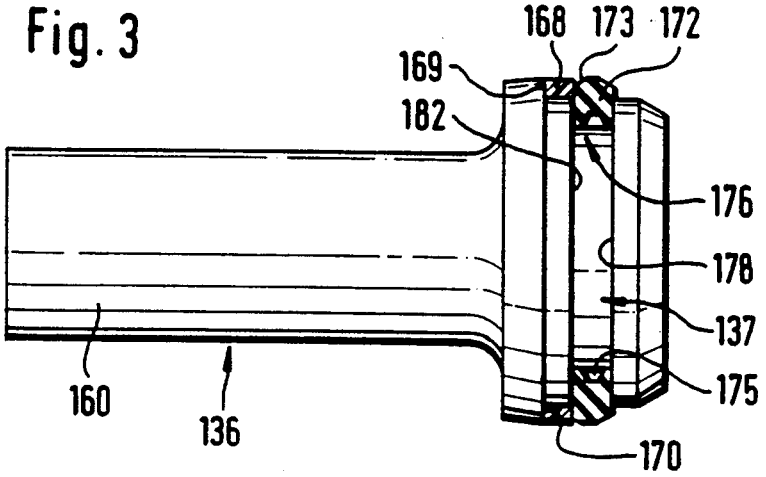
FIG. 3 is a view similar to FIG. 2 of another form of embodiment of the pendulum piston.

With reference to FIG. 3, another form of embodiment of the actuator piston is explained in more detail in the following. In this embodiment, those components which essentially correspond to the elements of the first form of embodiment are preceded by a "1" in the referencing. It is understood that the design can obviously also be used to the same degree for the return piston. The shape of actuator piston 136 according to FIG. 3 is identical to that of the form of embodiment according to FIG. 2. Guide ring designated by 168 also has a shape which corresponds to the shape of guide ring 68 of FIG. 2. Guide ring 168 is supported by lateral surface 169 on radial shoulder 170 of piston head 137. Recess 176 is provided for guide ring 168, into which radial elastic seal ring 172 is inserted in a form locking manner. Thus, seal ring 172 is also supported at the critical, radial outer area on the side of guide ring 168 opposite control space. An O-ring of the usual type can be used for sealing ring 172. In order to additionally increase or influence the radial elasticity of seal ring 172, a special geometric design is provided inside, for example in the form of a recess 175 and radially in the form of a curved surface 173.

From the present description, it can be seen that the design of the pendulum piston 36, 136 according to the invention no longer requires a spherical piston head, whereby the manufacturing cost can also be decreased.

Figure 4:
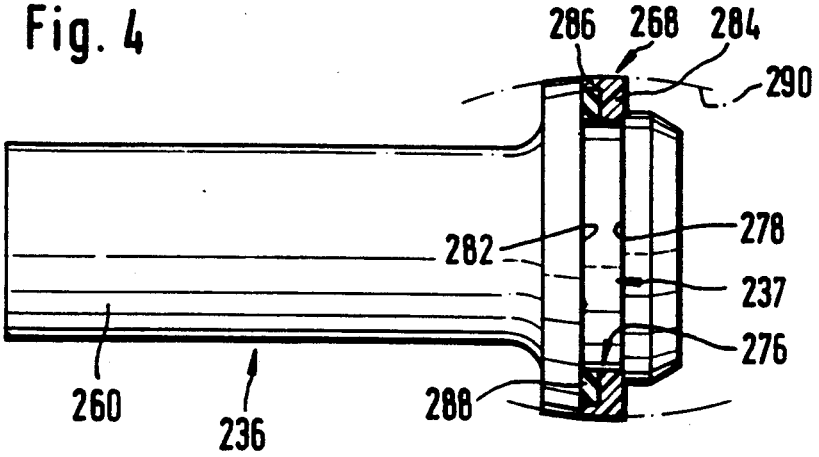
FIG. 4 is a view similar to FIGS. 2 and 3 of a third form of embodiment of the pendulum piston.

Finally, on the basis of FIG. 4, a third form of embodiment of the pendulum piston is described that can be employed in the hydropump according to the invention. In this embodiment those components which essentially correspond to the elements of the first form of embodiment are preceded by a "2" in the referencing.

Piston head 237 of this variant possesses only a single recess 276 in which a combined guide and sealing plastic ring is incorporated. Regarding the material used, guide ring designated by 268 is again selected from the same group of plastics as are considered for guide ring 68, 168 of the previously described exemplified embodiment. A left shoulder 282 supports the entire surface of the ring arrangement, while right shoulder 278 ensures that the plastic ring arrangement is retained. The cross section of guide ring 268 is in the shape of an L, with a thick flange 284 that extends essentially in the radial direction, and a thinner sealing side piece 286 extending at an angle to it, which is radially supported internally by an elastic lock ring 288. On the one hand, the sealing force can be determined by specifying the dimension of the flange 284, and on the other hand the sliding behavior can also be influenced. In another variation of the previously described exemplified embodiments, the outer contour of guide ring 268 is spherical or crowned, as is indicated by the dashed lines 290. However, considerably lessened demands are made with regard to the precision of this crowned surface as compared to the case of the previously used type of construction with embedded steel rings and a spherical piston head. Of course, it is also possible to fit or shrink the plastic components of the exemplified embodiments according to FIGS. 2 and 4 snugly onto a sphere.

The invention thus results in a vane pump or a vane motor having an adjustable displacement volume. The vane pump has a vane rotor and an annular stator that surrounds it eccentrically, the stator being stabilized by means of a piston arrangement for adjusting the degree of eccentricity that determines the displacement volume. The piston arrangement features at least one piston head that is acted upon by pressure medium and is guided in a sealed manner by a piston head lodged in a housing bore and delimiting a control space. To simply assembly and decrease manufacturing costs while simultaneously improving the sealing action and life of the guide surfaces, wear resistant, slidable plastic rings, which may be radially prestressed, are embedded, inserted or emplaced in the piston head to guide the head in the piston bore as well as to seal the control space.

We claim:

1. A vane pump having an adjustable displacement volume, a cell rotor and an annular stator eccentrically surrounding said cell rotor, said stator being stabilized by means of a piston arrangement for adjusting the degree of eccentricity that determines said displacement volume, whereby said piston arrangement includes at least one pendulum piston that is acted upon by a pressure medium, said pendulum piston being guided in a housing bore by a piston head that delimits a control space, said vane pump comprising:

a set of plastic rings emplaced in said piston head guiding said piston in said housing bore and sealing said control space, said plastic rings being constructed of wear resistant, sliding material wherein said plastic rings include a radially elastic seal ring arrangement and a separate guide ring, said guide ring supporting said seal ring arrangement in an axial direction on a side opposite said control space.

2. The vane pump according to claim 1, wherein said guide ring is received on a flat step in said piston of said piston head and is essentially supported on a shoulder of said piston.

3. The vane pump according to claim 1, wherein said seal ring arrangement is in the form of an elastic seal ring.

4. The vane pump according to claim 1, wherein said seal ring arrangement is formed by a seal ring and elastic O-ring on which said seal ring rests.

5. The vane pump according to claim 2, wherein a recess is connected to said flat piston step, and said seal ring arrangement is incorporated in said recess in a form locking manner.

6. The vane pump according to claim 3, wherein said seal ring is composed of a plastic material which is selected from a group of elastomers.

7. The vane pump according to claim 1, wherein said sliding material for said plastic rings is selected from a group of wear resistant, form-stable thermoplastic materials.

8. The vane pump according to claim 1, wherein said stator is respectively acted upon at diametrically opposed points by pendulum pistons, said stator being supported through an intermediate section resting on an adjustable support surface in order to make rolling movement possible between said stator and said support surface.

* * * * *